United States Patent [19]

Johdai et al.

[11] Patent Number: 4,958,820

[45] Date of Patent: Sep. 25, 1990

[54] SHEET STORING APPARATUS FOR COPYING MACHINE

[75] Inventors: Akiyoshi Johdai; Keichi Kinoshita; Hiroki Yamashita; Toshio Matsui, all of Osaka, Japan

[73] Assignee: Minolta Camera Kabushiki Kaisha, Osaka, Japan

[21] Appl. No.: 233,324

[22] Filed: Aug. 17, 1988

[30] Foreign Application Priority Data

| | | | |
|---|---|---|---|
| Aug. 20, 1987 | [JP] | Japan | 62-207646 |
| Aug. 20, 1987 | [JP] | Japan | 62-207647 |
| Aug. 20, 1987 | [JP] | Japan | 62-207649 |
| Aug. 20, 1987 | [JP] | Japan | 62-207650 |
| Aug. 20, 1987 | [JP] | Japan | 62-207651 |

[51] Int. Cl.[5] ..... B65H 39/00

[52] U.S. Cl. ..... 270/52; 270/58; 271/3.1

[58] Field of Search ..... 270/52, 53, 58; 271/3.1, 4; 355/308, 317, 319, 320

[56] References Cited

U.S. PATENT DOCUMENTS

| | | | |
|---|---|---|---|
| 3,386,729 | 6/1968 | Pine . | |
| 3,645,615 | 2/1972 | Spear, Jr. | 355/3 |
| 3,697,063 | 10/1972 | Greenfield et al. | 271/4 |
| 3,709,595 | 1/1973 | Turner et al. | 355/14 |
| 3,944,207 | 3/1976 | Bains | 270/58 |
| 4,067,649 | 1/1978 | Hubbard et al. . | |
| 4,073,391 | 2/1978 | O'Brien et al. | 214/65 |

(List continued on next page.)

FOREIGN PATENT DOCUMENTS

| | | | |
|---|---|---|---|
| 0099250 | 1/1984 | European Pat. Off. . | |
| 2732673 | 9/1978 | Fed. Rep. of Germany . | |
| 3218747 | 12/1982 | Fed. Rep. of Germany . | |
| 3701450 | 7/1987 | Fed. Rep. of Germany . | |
| 55-15150 | 2/1980 | Japan . | |
| 55-44433 | 3/1980 | Japan | 271/3.1 |
| 57-72537 | 5/1982 | Japan . | |
| 51-90334 | 6/1982 | Japan | 271/3.1 |
| 57-131667 | 8/1982 | Japan . | |
| 57-203037 | 12/1982 | Japan . | |
| 59-43765 | 3/1984 | Japan . | |
| 59-177232 | 10/1984 | Japan . | |
| 61-145069 | 12/1984 | Japan . | |
| 60-183461 | 9/1985 | Japan . | |
| 60-248563 | 12/1985 | Japan . | |
| 61-72569 | 4/1986 | Japan . | |
| 26061 | 6/1986 | Japan . | |
| 61-261096 | 11/1986 | Japan . | |
| 2185465 | 7/1987 | United Kingdom . | |

OTHER PUBLICATIONS

*Xerox Disclosure Journal,* "System for Automatically Adjusting Side Guides", by Collins, vol. 1, No. 9/10, Sep./Oct. 1976.

Xerox Disclosure Journal, vol. 2, No. 5, Sep./Oct. 1977.

IBM Technical Disclosure Bulletin, vol. 18, No. 9, Stapler Unloader for Copier, Galle et al., 2/76.

*Primary Examiner*—Edward K. Look

*Assistant Examiner*—Therese M. Newholm

*Attorney, Agent, or Firm*—Burns, Doane, Swecker & Mathis

[57] ABSTRACT

An apparatus for storing the sheets discharged from a copying machine or the like vertically for subsequent refeeding of the sheets to the copying machine, comprises side regulating plates for regulating the side ends of the stored sheet, a lower regulating plate for regulating the lower end of the stored sheet, a guide member for guiding each of the sheets transported downward to the lower regulating plate and holding the sheet in a widthwise deflected condition, a paddle wheel for urging each of the sheets downward, a refeeding belt for refeeding the stored sheets, and a separation pad for preventing the sheets from being refed in plurality of a time by contacting the refeeding belt. The side regulating plates are moved back and forth, the lower regulating plate is moved donward and upward, the refeeding belt is rotated backward, and the separation pad is moved away from the refeeding belt in response to the detection signal from a sensor with respect to each of the sheets being refed.

19 Claims, 15 Drawing Sheets

U.S. PATENT DOCUMENTS 4,076,408 2/1978 Reid et al. ..... 355/14
4,123,155 10/1978 Hubert .
4,134,672 1/1979 Burlew et al. .
4,145,037 5/1979 Mol .
4,190,246 2/1980 Sasuga .
4,203,587 5/1980 Kishi et al. .
4,218,128 8/1980 Satomi et al. .
4,227,275 10/1980 Söderberg .
4,238,066 12/1980 Brooke ..... 227/39
4,248,413 2/1981 Fox ..... 270/53
4,248,525 2/1981 Sterrett ..... 355/14 SH
4,265,440 5/1981 Shibazaki et al. .
4,272,180 6/1981 Satomi et al. .
4,281,920 8/1981 Cross .
4,295,733 10/1981 Janssen et al. .
4,313,670 2/1982 Caldwell .
4,361,393 11/1982 Noto ..... 355/3 SH
4,365,886 12/1982 Murakami et al. ..... 355/3 SH
4,368,972 1/1983 Naramore .
4,371,155 2/1983 Astero et al. ..... 270/53
4,376,529 3/1983 George et al. .
4,385,827 5/1983 Naramore .
4,411,515 10/1983 Kukucka et al. .
4,419,007 12/1983 Kingsley ..... 271/3.1
4,424,963 1/1984 Bartholet et al. .
4,466,733 8/1984 Pels ..... 270/58
4,473,425 9/1984 Baughman et al. .
4,497,478 2/1985 Reschenhofer et al. .
4,515,458 5/1985 Masuda et al. .
4,540,166 9/1985 Massengeil ..... 271/3.1
4,549,804 10/1985 Braun et al. ..... 355/14 SH
4,564,185 1/1986 Hamlin et al. .
4,566,782 1/1986 Britt et al. .
4,573,789 3/1986 Wada .
4,582,421 4/1986 Hamlin et al. .
4,592,651 6/1986 Oikawa et al. .
4,595,187 6/1986 Bober .
4,603,971 8/1986 Kukucka et al. .
4,626,156 12/1986 Baughman et al. .
4,647,034 3/1987 Sawa .
4,647,188 3/1987 Komiya et al. .
4,674,732 6/1987 Hori ..... 270/53
4,674,866 6/1987 Tanaka .
4,687,191 8/1987 Stemmle .
4,702,589 10/1987 Ito ..... 355/14 SH
4,718,657 1/1988 Otter et al. .
4,721,382 1/1988 Ito et al. .
4,730,206 3/1988 Sawada et al. .
4,743,945 5/1988 Ito et al. ..... 355/14 SH
4,763,889 8/1988 Dei et al. .

FIG. 8b
FIG. 8c
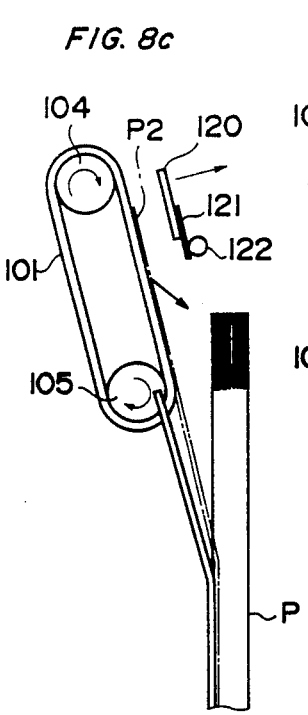
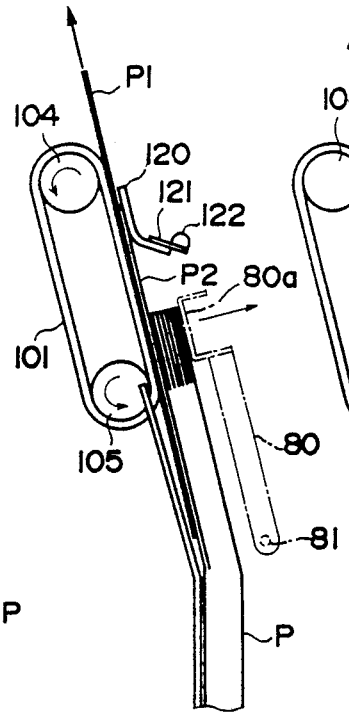
FIG. 8a
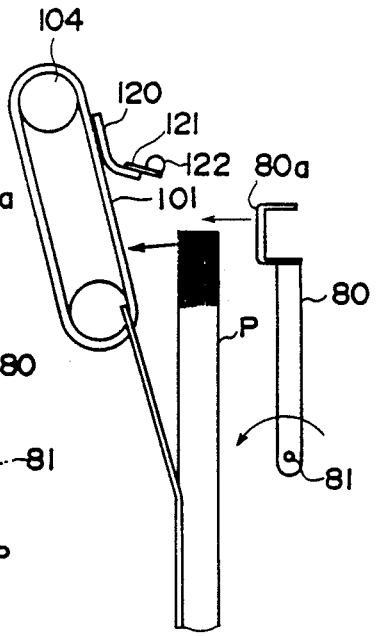

SHEET STORING APPARATUS FOR COPYING MACHINE

BACKGROUND OF THE INVENTION

1. Field of the Invention

The present invention relates to a sheet storing apparatus, in particular, a sheet storing apparatus for storing therein sheets havIng an image formed thereon by a copying machine and subsequently refeeding the stored sheets to the copying machine.

2. Description of Related Art

Recently, there have been provided various sorts of copying machines having automatic duplex/composite copying functions. These copying machines employ a sheet storing arrangement for storing the sheets having an image formed on one side thereof prior to the sheets being refed, such that the sheets are horizontally placed at a location under the image forming unit of the copying machine or at a location adjacent one side of a sheet discharge port. However, the former arrangement has the disadvantages that the mechanism for dealing with sheet jamming is complicated and that the apparatus requires high rigidity and inevitably the copying machine itself must be of a large size. The latter arrangement requires a large floor space and, especially where a sorter or the like are connected thereto, a very large space is required for installation.

In order to overcome these difficulties, it may be conceivable to adopt an arrangement such that sheets are placed at one side of the discharge portion of the copying machine by piling them generally vertically in the thicknesswise direction thereof. However, such vertical placement of sheets involves a problem that sheets are liable to buckle, which may act as a resistance factor upon subsequent placement of sheets and result in defective placement, placement failure, defective refeed, or refeed failure.

With sheet feeding apparatus or refeeding apparatus for one-side copied sheets in a copying machine, it is necessary that a plurality of sheets laid one over another must be fed forward accurately one by one. In the prior art, therefore, for example, as disclosed in Japanese Utility Model Unexamined Publication No. 57-203037, a sheet separation unit is employed such that a resilient member is pressed against a power drive roller so that a second and subsequent sheets which may tend to accompany a first sheet are halted by the friction force of the resilient member. However, such sheet separation unit involves a problem that after the first sheet is fed forward, the front ends of the second and subsequent sheets may remain as it is carried between the roller and the separation resilient member, thus causing duplicate feed.

SUMMARY OF THE INVENTION

In view of the above-mentioned problems, an object of the present invention is to provide a sheet storing apparatus which can be more compact and prevent buckling of the sheets stored, and thus eliminate defective placement or placement failure.

Another object of the present invention is to provide a sheet storing apparatus which can be more compact and accurately store a multiplicity of sheets.

Still another object of the present invention is to provide a sheet storing apparatus which can positively prevent duplicate feeding.

To attain the above object, a sheet storing apparatus according to the present invention, for storing therein the sheets having an image formed thereon by an image forming apparatus in substantially vertically placed condition, comprises: a receiving roller for receiving each of the sheets discharged from the image forming apparatus and transporting the sheets substantially vertically downward; a bottom plate for regulating the front end of each of the sheets transported downward by the receiving roller so that the sheets are substantially vertically held thereon; and a guide member for guiding each of the sheets transported downward to the bottom plate and holding the sheets in a widthwise deflected condition.

According to the above arrangement, sheets are delivered one by one generally vertically into a storing portion in which each sheet is transported while being guided by the guide member and is stored in such condition that its front end is positionally regulated by the bottom plate. In this case, each sheet is regulated in the widthwise deflected condition as if it is provided with stiffness, so that it is prevented from buckling.

Further, a sheet storing apparatus according to the present invention comprises said receiving roller, said bottom plate, a guide member for guiding each of the sheets transported downward to the bottom plate, and a wheel member disposed at a distance from the guide member and rotated in the direction for urging each of the sheets downward.

According to the above arrangement, sheets are delivered one by one generally vertically into a storing portion, and after each sheet leaves the receiving roller, it is allowed to move along its way under the transport force given through the rotation of the wheel member so that even if there is any resistance against its advance, the sheet is accurately stored in position. The force of transport imparted by the wheel member does not act so much where the sheets stored are small in number and not much resistance is present against sheet advance, but it becomes stronger as resistance against sheet advance increases as a result of more than a certain number of sheets having been stored.

Further, a sheet storing apparatus according to the present invention comprises: a sheet storing unit for storing sheets in substantially vertical placed condition; a lower regulating plate, which is movable in the vertical direction, for regulating the lower end of the sheets stored in the sheet storing unit; side regulating plates, which are movable in the horizontal direction, for regulating the side ends of the sheets stored in the sheet storing unit; a refeeding member, which is rotatable in the refeeding direction, for refeeding the stored sheets: a separation member movable toward and from the refeeding member and adapted to prevent the sheets from being refed by the refeeding member in plurality at a time; a sensor for detecting each of the sheets refed by the refeeding member; and control means for causing the separation member to move away from the refeeding member and the lower and side regulating plates to move back and forth in response to the detection signal from the sensor.

According to the above arrangement, sheets are stored in such condition that they are placed one over another in the thicknesswise direction. Subsequently, the sheets are refed one by one as the refeeding member is rotated. In this case, the separation member pressed against the refeeding member prevents duplicate feeding of second and subsequent sheets. When each refed sheet is detected by the sensor, the separation member moves away from the refeeding member and, thereupon, side regulating plates strike both sides of the sheets stored and the lower regulating plate moves downward and upward. Accordingly, the sheets are vibrated and moved downward and upward. Therefore, the second and succeeding sheets of which front ends have been carried to the position of the separation member are caused to return to their original position.

BRIEF DESCRIPTION OF THE DRAWINGS

These and other objects and features of the present invention will become apparent from the following description taken in conjunction with preferred embodiments thereof with reference to the accompanying drawings, in which;

FIG. 1 through FIGS. 12*a* and 12*b* show an embodiment of the present invention;

FIG. 1 is a schematic block diagram showing a copying machine and a refeeding apparatus;

FIG. 2 is an internal composition of the refeeding apparatus;

FIG. 3 is a cross sectional plan view of a storing section;

FIG. 4 is a perspective view of a intermediate storing section and a refeeding section;

FIG. 5 is a perspective view of a driving mechanism for side regulating plates;

FIG. 6 is a perspective view of a driving mechanism for a separation pad;

FIG. 7 is a perspective view of a drive direction changing mechanism for a refeeding belt;

FIGS. 8*a*, 8*b*, and 8*c* are explanatory drawings showing a sheet refeeding operation;

FIG. 9 is a diagram showing a control circuit;

FIG. 10 is a flow chart showing a main routine of a CPU:

FIGS. 12*a* and 12*b* are flow charts showing a subroutine for refeeding sheets;

DETAILED DESCRIPTION OF THE PREFERRED EMBODIMENTS

[First Embodiment]

The embodiment of the invention will now be described with reference to the accompanying drawings wherein the invention is applied as a sheet refeeding apparatus for a copying machine. (General constitution of copying machine)

Figure 1:
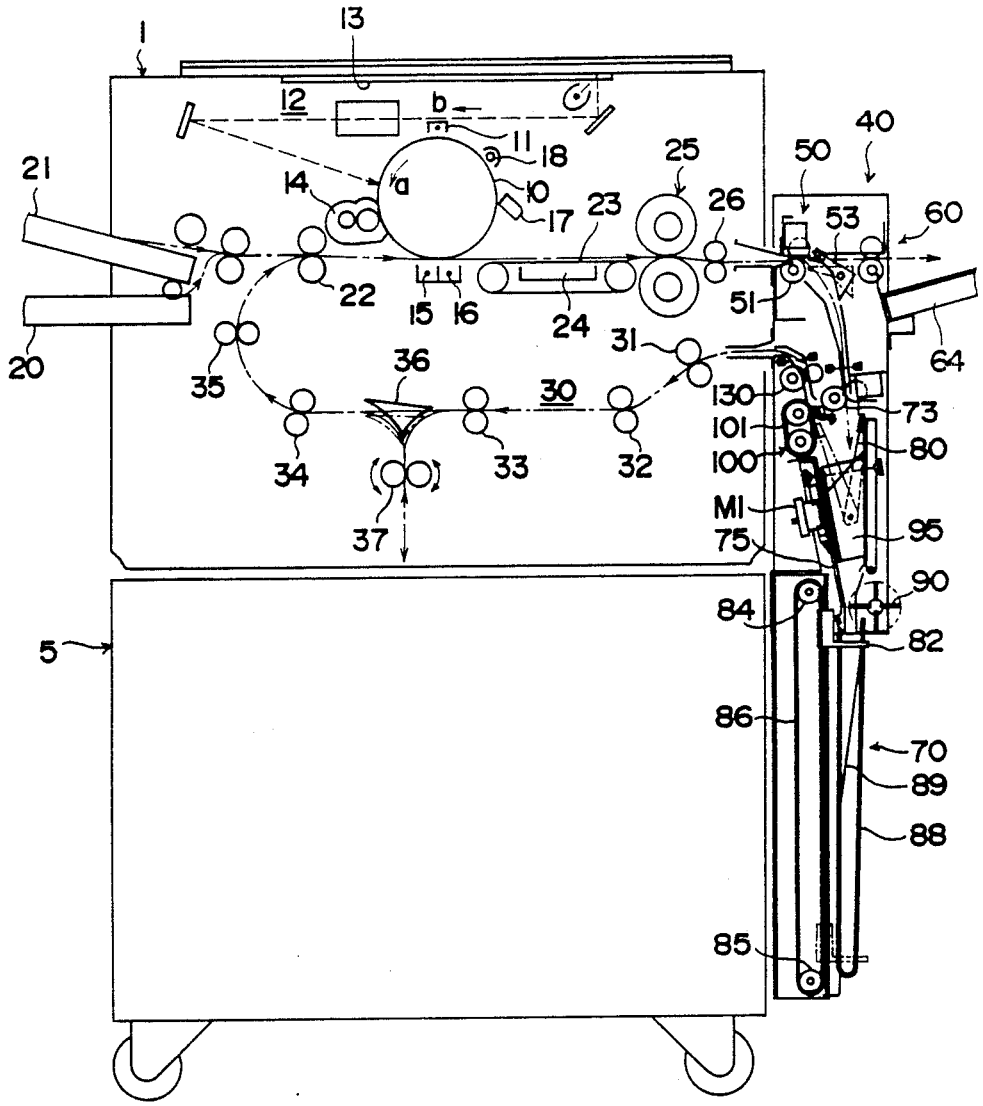

The copying machine 1 is placed on a desk 5 as shown in FIG. 1, and forms document images on sheets using a well-known electro-photographic method. Inside the copying machine 1, a photosensitive drum 10 to be rotated towards the direction of an arrow (a) is charged with a certain amount of static electricity by an electrifying charger 11, and the image of the document set on a document glass 13 is exposed to the light through a slit when an optical exposure system 12 scans the document towards the direction of an arrow (b). This causes an electrostatic latent image formed on the photosensitive drum 10 to be developed into a toner image by a magnetic brush type developing device 14 and then transferred onto a sheet by a transfer charger 15.

The drum 10 is continued to rotate towards the direction of the arrow (a) even after the toner image is transferred so that the residual toner can be removed by a blade type cleaning device 17, and simultaneously the residual electrostatic charge is erased by an eraser lamp 18 in order to prepare for the next copying operation.

Copying sheets which are loaded in automatic feeding cassettes 20 and 21, are fed one by one from a specific cassette selected from the cassette 20 or 21. Then, by a pair of timing rollers 22, a fed sheet is synchronized with a toner image formed on the surface of the drum 10 and is transported to a transfer portion. After the transfer processing, the sheet is separated from the drum 10 by means of the AC corona discharge of a separation charger 16 and its stiffness.

Further, the sheet is delivered to a fixing unit 25, by a transport belt 23, which is provided with an air suction unit 24, where the toner image is fixed to the sheet, then the sheet is discharged by a pair of discharge rollers 26.

In contrast, under the photosensitive drum 10 there is provided a refeeding passageway 30 for transporting refed sheets to the pair of timing rollers 22 from a refeeding apparatus 40 which will be hereinafter described. This passageway 30 comprises pairs of transport rollers 31, 32, 33, 34 and 35, guide plates (not shown) disposed therearound, a changeover pawl 36 disposed between the pairs of transport rollers 33 and 34, and a pair of switchback rollers 37. Sheets, with image portion turned up, are fed from the refeeding apparatus 40 into the passageway 30. Therefore, for the duplex copying purposes, the changeover pawl 36 is set at the position indicated by the dashed line so as to allow each sheet to pass on the pawl 36. Each sheet is reversed at the pair of rollers 35 so that its copied surface is turned down, being then transported from the pair of timing rollers 22 to the transfer portion in which copying is made on the back side of the sheet. For the purpose of the composite copying, the changeover pawl 36 is set at the position indicated by the solid line. In this case, each refed sheet is guided downward by the right side portion of the pawl 36 as shown in FIG. 1 so that it is transported downward through forward run of the pair of rollers 37. After the rear end of the sheet passes through the changeover pawl 36, the run of the pair of rollers 37 is reversed so that the travel of the sheet is reversed, with its leading side now changed to trailing side, being then guided leftward by the left side portion of the pawl 36 and transported to the transfer portion through the pair of rollers 34, 35 and further through the pair of timing rollers 22. Thereupon, the sheet is reversed so that its copied surface is turned up, being subjected to copy once again. (Refeeding apparatus)

Figure 2:
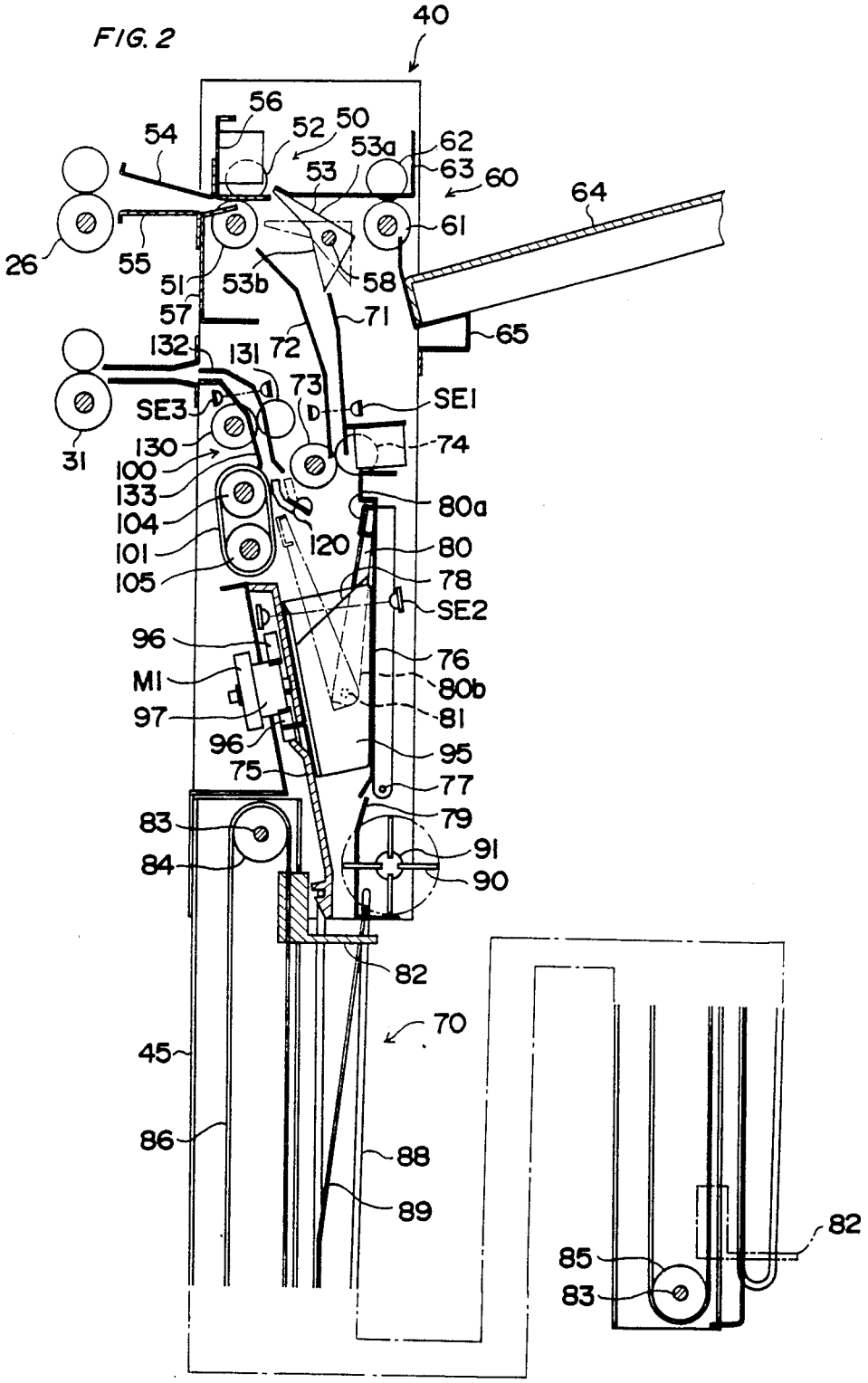

As shown in FIG. 2, the refeeding apparatus 40 comprises a receiving section 50 for receiving the sheets discharged from the pair of discharge rollers 26 on the copying machine 1 and changing the direction of sheet transport, a discharge section 60 for finally storing sheets on a tray 64, an intermediate storing section 70 for storing sheets for subsequent refeeding, and a refeeding section 100 for refeeding sheets into the refeeding passageway 30.

The receiving section 50 comprises a transport roller 51 which is driven by a transport motor not shown, a pinch roller 52 which presses against the roller 51 for being driven in association therewith, a changeover pawl 53 for switching over the direction of sheet transport, and guide plates 54, 55, 56 and 57. The changeover pawl 53 is pivotally supported on a support shaft 58, being pivotable from the dashed line position to the solid line position by switching on a solenoid not shown. When the pawl 53 is in the dashed line position, it guides each sheet by its upper surface 53*a* toward the discharge section 60, and when the pawl 53 is in the solid line position, it guides each sheet by its side surface 53*b* toward the intermediate storing section 70.

The discharge section 60 comprises a roller 61 which is driven by the transport motor similarly to the roller 51, a pinch roller 62 which presses against the roller 61 for being driven in association therewith, a guide plate 63, and a discharge tray 64. The discharge tray 64 is removable through a support plate 65 and may be replaced by a sorter not shown. When the one-side copying mode is selected, and when the duplex/composite copying mode is selected and second copying is completed, sheets are discharged to the discharge tray 64.

The intermediate storing section 70 is intended for storing sheets on one side of which an image is reproduced when the sheets are discharged from the copying machine 1 in the case of the duplex/composite copying mode having been selected, and is vertically disposed. More specifically, the intermediate storing section 70 comprises guide plates 71 and 72, a transport roller 73 which is driven by the transport motor similarly to the rollers 51 and 61, a pinch roller 74 which presses against the roller 73 for being driven in association therewith, a base plate 75 and guide plates 76 and 79, the former and the latter being disposed in opposed relation, a presser plate 80, a lower regulating plate 82, first guide members 89 and 89, second guide members 89 and 89, a paddle wheel 90, and side regulating plates 95 and 95. The guide plates 71 and 72 are provided at their respective lower portions with a transmission type sensor SE1 for detecting sheets transported. On the base plate 75 and the guide plate 76 there are disposed a transmission type sensor SE2 for detecting whether or not sheets are stored in the storing section 70.

The lower regulating plate 82 regulates the lower end (i.e., the front end as seen in the direction of sheet transport) of the sheets stored in the storing section 70. The plate 82 is fixed to a timing belt 86 carried around pulleys 84 and 85 fixed on shafts 83 and 83 supported in a frame 45 and is movable up and down upon rotation force being transmitted to the pulley 84 by a reversible motor. It is positioned to a height corresponding to the relevant sheet size. In the embodiment, the arrangement is such that A4 size and B5 size sheets can be transported on longitudinal positioned and latitudinal positioned respectively, and A3 size and B4 size sheets can be transported on longitudinal positioned, transport regulation being center based in all cases. In FIG. 2, the position shown by the solid line is a regulating position in the case of latitudinal positioned for B5 size, a minimum size, and the lower regulating plate 82 assumes this position as its home position, from which it is moved to a position corresponding to any relevant sheet size when the motor is driven. The position shown by the dashed line is a regulating position in the case of longitudinal positioned for B3 size, a maximum size. The reason why the lower regulating plate 82 is moved in this way according to the sIze of sheets is that the upper edge of the sheets stored has to be held at a constant level in preparation for subsequent refeed operation, the upper end level of the lower regulating plate 82 being taken as a level at which the upper portion of each sheet is ready to touch the refeeding belt 101 as shown in FIGS. 8*a*, 8*b* and 8*c*.

During the refeeding operation, the lower regulating plate 82 is controlled so that it moves up and down each time a sheet is refed, which will be described hereinafter.

Figure 3:
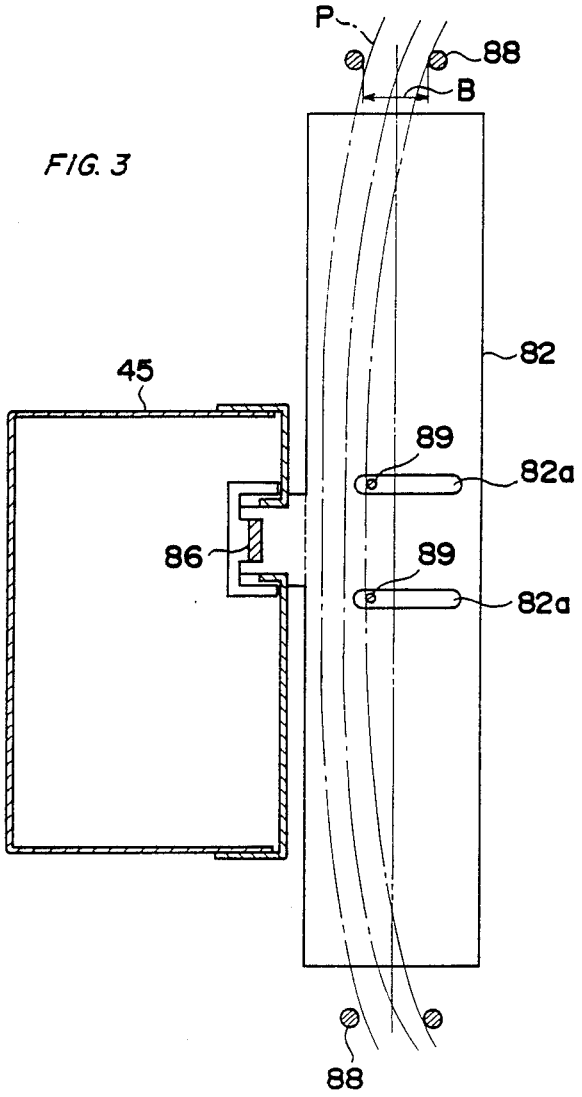

The first guide members 88 and 88, made of a wire material having comparatively high rigidity, and disposed at positions suitable for regulating sides of sheets over a movable range of the lower regulating plate 82 as shown in FIG. 3. The distance (B) between the respective first guide members 88 and 88 is set slightly greater than the thickness of accommodatable number of sheets. The second guide members 89 and 89, made of a wire material having good resiliency are disposed at a position suitable for reducing the thicknesswise distance set by the first guide members 88 and 88 and opposite the widthwise center position for sheets, passing through slits 82*a* and 82*b* of the lower regulating plate 82 as shown in FIG. 3.

These guide members 88 and 89 are constructed of a wire material in order to minimize possible resistance against sheets fed. They prevent sheets stored from slipping from the lower regulating plate 82 and also function to enable sheets to be loaded smoothly and prevent sheets from buckling. Thus, sheets are regulated by the first guide members 88 and 88 at both sides and are also centrally regulated by the second guide members 89 and 89 while being urged toward the left as shown in FIG. 3. Accordingly, the sheets are bent as shown by the dashed line in FIG. 3, which means that they are provided with nerve, so that the sheets can be smoothly received until their front ends are brought into abutment with the lower regulating plate 82. After being stored in the position, the sheets are free from buckling possibilities.

When providing the sheets with stiffness as such, it is necessary to take into consideration the condition of their curl, if any, so that not to cause any excessive resistance of the first and second guide members 88 and 89 to the sheets stored which may result in defective loading of defective refeeding. Since the second guide members in particular are made of a resilient wire material, when inherently resilient sheets, such as boardpaper, are stored, the second guide members are moderately outwardly deflected by the resiliency of the sheets so that the degree of bending the sheets is reduced to permit smooth sheet storing. It is preferred that the degree of such bending is variable according to the material of sheets and the desired number of sheets to be stored. For this purpose, not only the second guide members but also the first guide members may be constructed of a resilient material.

The second guide members 89 and 89 are each bent at a median portion, and the distance for sheet regulation by them is set smaller at the downstream side of sheet storing/transport than at the upstream side. The reason why the upstream side distance is set wider is that short-size sheets require no much consideration against buckling. Another reason is that in the case of long-size sheets, it is their lower hal: portion that requires consideration against buckling. Rather, it is considered more advantageous to minimize the resistance to sheet feed. Further, if sheets are excessively provided with resistance to buckling, defective sheet refeed may result. By making the distance at the downstream side it is meant that in the case of long-size sheets, greater resistance to buckling should be imparted to the lower half portion of the sheets which would otherwise be likely to become buckled.

The guide plate 76 has an antistatic brush 78 and is outwardly pivotable about a support shaft 77 in case of sheet jamming. The angle between the transport roller 73 and the pinch roller 74 and a nip portion, that is, the angle at which a sheet is delivered by the rollers 73 and 74, is so set as to orient the sheet toward the guide plate 76 so that the front end of the incoming sheet is prevented from touching the upper edge of the sheets previously stored. Each sheet delivered from the rollers 73 and 74 first goes in slide contact with the pressing face 80*a* of the presser plate 80 and is then guided by the guide plates 76 and 79 while being subjected to static elimination by the antistatic brush 78, being then placed between the first and second guide members 88 and 89.

Figure 4:
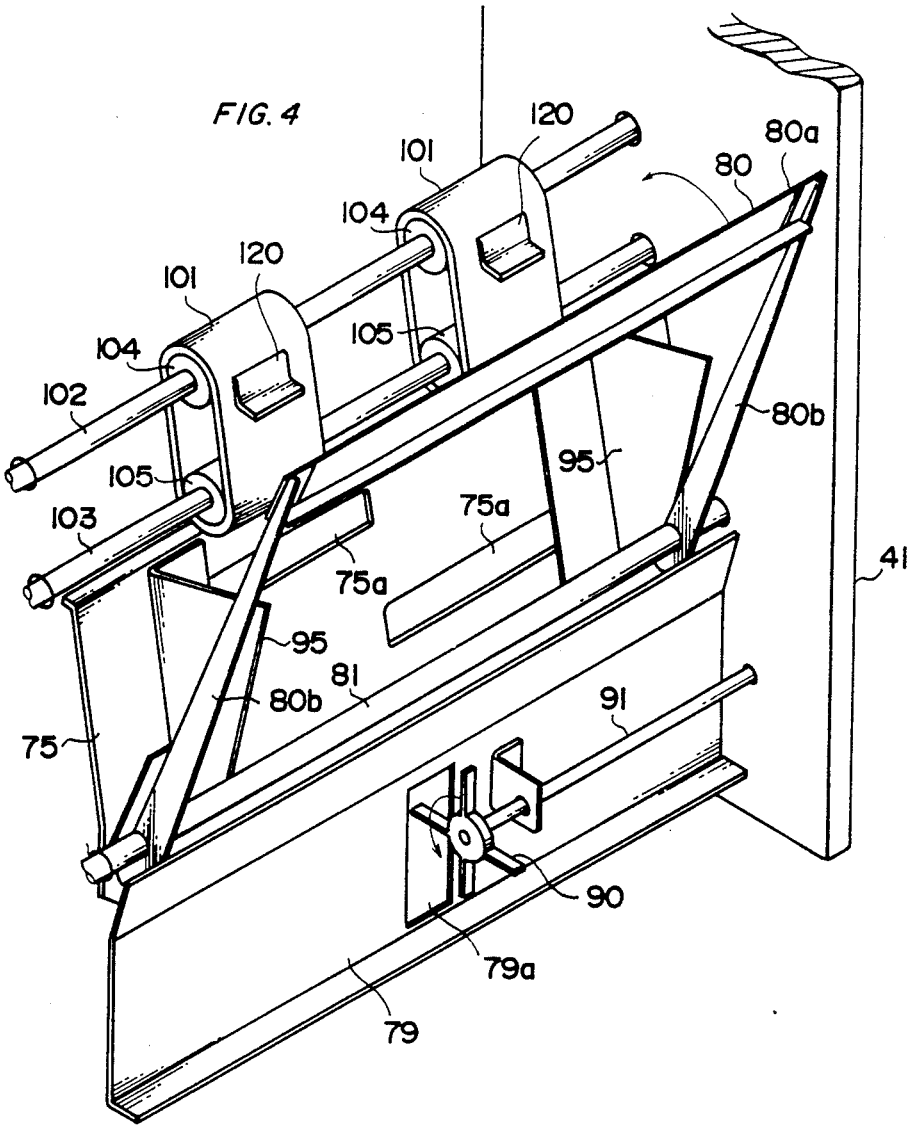

As shown in FIG. 4, the paddle wheel 90 comprises blade members fixed to a shaft 91. The paddle wheel 90 projects from an opening 79*a* of the guide plate 79 toward the base plate 75 and is motor-powered for counterclockwise rotation through a reduction gear mechanism not shown. This paddle wheel 90 operates to give a supplementary transport force to each of the sheets toward storing sheets through its rotation. The distance between the center of the paddle wheel 90 and the nip portion of the rollers 73 and 74 is set smaller than the length of an accommodatable minimum size sheet (i.e., B5 size sheet latitudinal positioned in this embodiment). The front end of the paddle wheel 90 is spaced a predetermined distance from the base plate 75 so that if the number of sheets stored is small and there is little resistance to sheet transport, no more mobility than required is given to sheets, each sheet being prevented from "crease" development thereon. If more than a predetermined number of sheets has been stored, the paddle wheel 90 will thereafter press the sheets strongly against the base plate 75 as the sheets stored are increased in number and impart high mobility in proportion to the increase in the number of sheets.

In the process of sheet refeeding, the paddle wheel 90 does not go in contact with the sheets when the number of sheets is decreased to a level below a certain number, and there will be no transport resistance from the paddle wheel 90.

As shown in FIG. 4, the presser plate 80 comprises arms 80*b* and 80*b* located off the both side ends of maximum size sheets, a pressing face 80*a* mounted to the front end of each of the arms 80*b* and 80*b*, and a support shaft 81 supported by the frames 41 and 41. The presser plate 80 is pivotable about the support shaft 81, and when a solenoid not shown is switched on, the presser plate 80 is pivotally moved to the dashed line position from the solid line position as shown in FIG. 2. When the solenoid is switched on in response to the signal from the sensor SE1 indicating the detection of the rear end of the sheet in the course of being stored, the presser plate 80 is turned to the dashed line position to press the upper edge of the sheet received against the base plate 75. This is done to prevent the front end of the incoming sheet from striking the upper edge of the previously stored sheets. The presser plate 80 itself is caused to retreat to the solid line position by the solenoid being switched off in response to the signal from the sensor SE1 indicating the detection of the front end of the succeeding sheet, immediately before the front end of the incoming sheet can reach the pressing face 80*a*.

During the refeeding operation, the presser plate 80 is controlled to be pivotally moved in conjunction with refeeding movement of the sheets, which will be described hereinafter.

Figure 5:
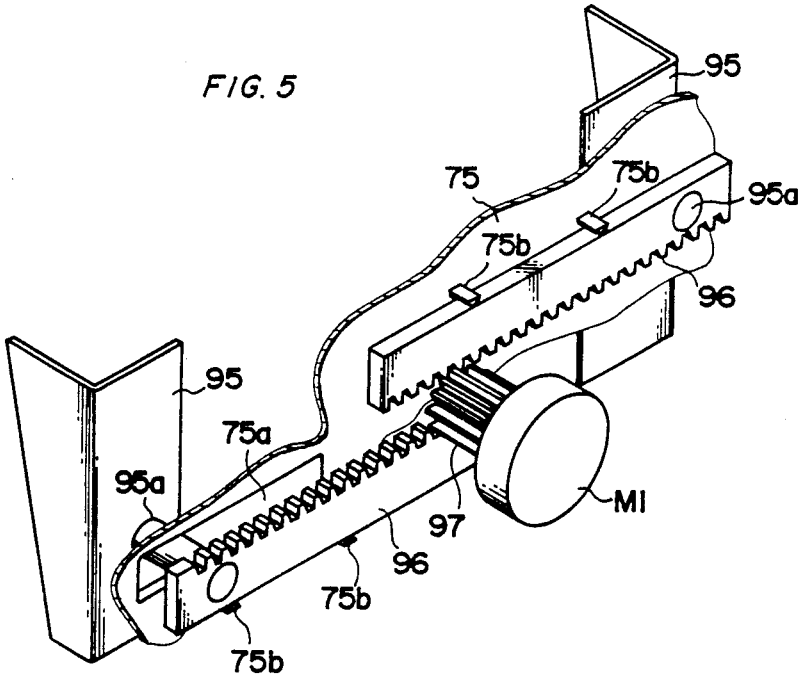

As shown in FIGS. 4 and 5, the side regulating plates 95 and 95 are each movable in the widthwise direction of sheets as shafts 95*a* and 95*a* fixed to its backside goes into slide movement in slits 75*a* and 75*a* formed on the base plate 75. Racks 96 and 96 are fixed to the shafts 95*a* and 95*a* on the back of the base plate 75. The racks 96 and 96 are in engagement with a pinion 97 of a reversible motor M1, being guided by projections 75*b* and 75*b* formed on the base plate 75. Therefore, by the motor M1 being driven forward and reverse, the side regulating plates 95 and 95 are moved rightward and leftward together with the racks 96 and 96, being thus moved to their respective regulating positions corresponding to any relevant size of sheets from positions corresponding to the sides of maximum size sheets, which positions constitute their home position.

During the sheet storing operation the side regulating plates 95 and 95 receive sheets as they are slightly moved outward. The motor M1 is driven clockwise as shown in FIG. 5 in response to the signal from the sensor SE1 indicating the detection of the front end of a sheet, and the side regulating plates 95 and 95 are held on standby at positions spaced wider than the width of the sheet, in which condition the sheet is received in position. When the front end of the sheet is going to contact the lower regulating plate 82, the motor M1 is driven in reverse in response to the signal from the sensor SE1 indicating the detection of the rear end of the sheet, and the lower regulating plate 82 is reset to a position corresponding to the size of the sheet. Thus, a positional deviation of sheet transport is corrected.

During the sheet refeeding operation, the side regulating plates 95 and 95 are controlled for reciprocal movement each time a sheet is refed, which will be described hereinafter.

The refeeding section 100 operates to refeed sheets, one by one, in order of seniority when a signal for copying is given with respect to one-side copied sheets stored in the intermediate storing section 70. More specifically, the refeeding section 100 comprises a refeeding belt 101, a separation pad 120 movable toward and from the refeeding belt 101, and a transport roller 130 which is driven by the transport motor as in the case with the rollers 51, 61 and 73, a pinch roller 131 which presses against the roller 130 for being driven in association therewith, and guide plates 132, 132. On the guide plates 132 and 132 there is mounted a transmission type sensor SE3 for detecting a refed sheet being caught between the rollers 130 and 131.

Figure 6:
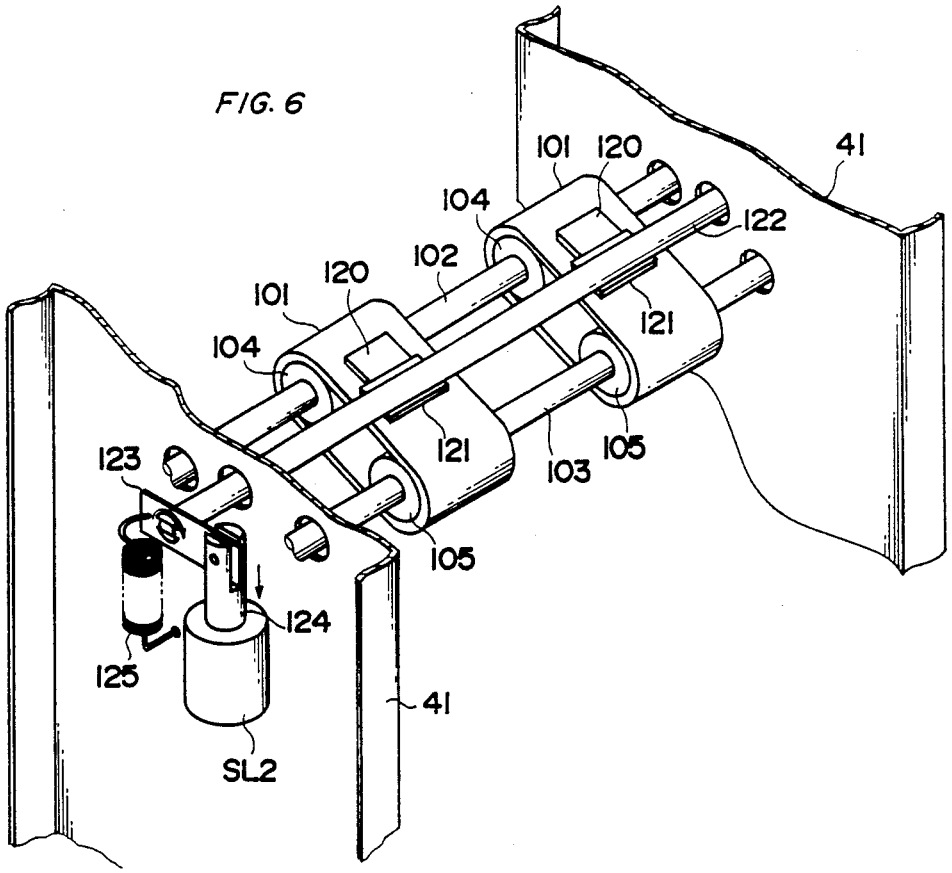

As shown in FIGS. 4 and 6, the refeeding belt 101 is trained endlessly around pulleys 104 and 105 mounted on support shafts 102 and 103 provided between the frames 41 and41, and as the pulley 104 is rotated forward and reverse, the refeeding belt 101 is driven in conjunction with the pulley 105.

Figure 7:
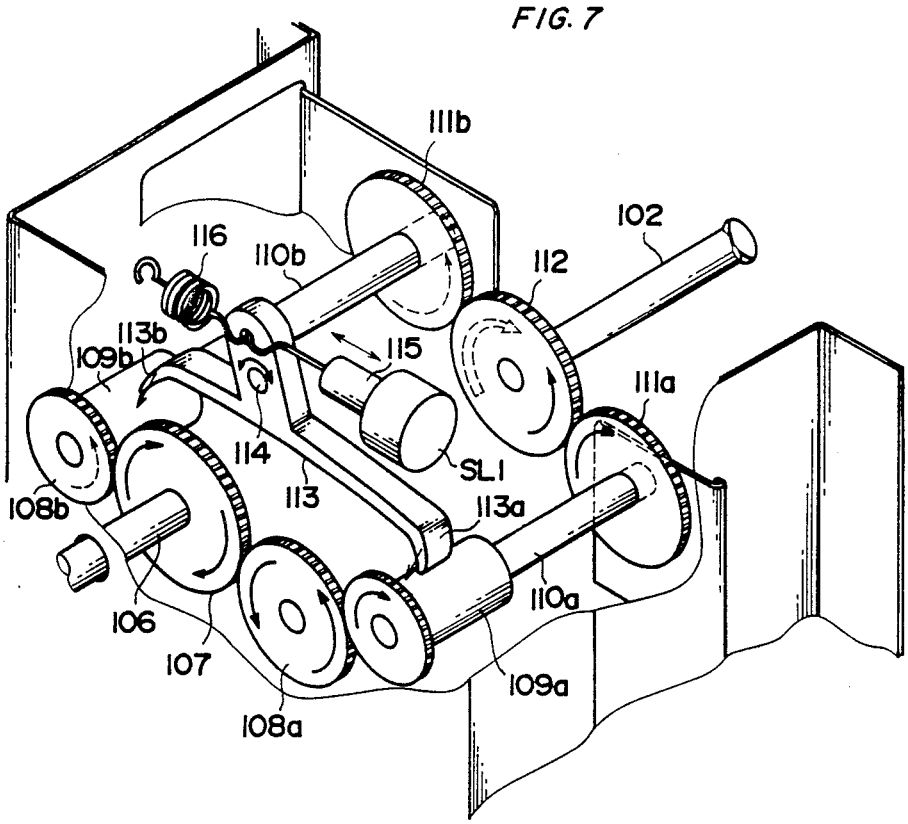

In this connection, a forward/reverse changeover drive mechanism for the refeeding belt 101 will be explained with reference to FIG. 7.

A drive shaft 106 is connected at one end to an output of the transport motor not shown, and a gear 107 is mounted to the other end of the drive shaft 106. The drive shaft 106 is driven to rotate clockwise. The gear 107 is engaged on both sides by an idle gear 108*c* and a reverse gear 108*b*, and the idle gear 108*c* is in engagement with a forward gear 108*a*. The gears 108*a* and 108*b* are mounted on support shafts 110*a* and 110*b* through collars 109*a* and 109*b* incorporating a kick spring not shown. Gears 111*a* and 111*b* fixed to one end of the support shafts 110*a* and 110*b* are in engagement with a gear 112 at both sides thereof, the gear 112 being fixed to one end of the support shaft 102.

A clutch pawl 113 having pawl portions 113*a* and 113*b* is pivotally movable around a support shaft 114, to which the clutch pawl 113 there are connected a plunger 115 of a reverse solenoid SL1 and a spring 116 in opposed relation. The reverse solenoid SL1 is normally kept in off condition, which is prevented from rotating by the pawl portion 113*b* of the clutch pawl 113 being in engagement with the collar 109*b*. In this case, another pawl portion 113*a* is in the condition of nonengagement with the outer periphery of the collar 109*a*. When the reverse solenoid SL1 is turned on, the clutch pawl 113 is pivotally moved in clockwise direction so that one pawl portion 113*a* goes into engagement with the outer periphery of the collar 109*a*, while the other pawl portion 113*b* is disengaged from the outer periphery of the collar 109*b*. When the pawl portion 113*a* or 113*b* is in the condition of nonengagement with the collar 109*a* or 109*b*, the gear 108*a* or 108*b* is rotated along with the collar 109*a* or 109*b* under a clutch force of the kick spring in the collar 109*a* or 109*b*, a rotational force being thus transmitted to the shaft 110*a* or 110*b* and the gear 111*a* or 111*b*. When the pawl portion 113*a* or 113*b* goes into engagement with the collar 109*a* or 109*b* to prevent the rotation of the latter, the clutch force of the kick spring is removed, and accordingly the gear 108*a* or 108*b* is freely rotatable, with the result that there is no transmission of rotation force to the support shaft 110*a* or 110*b*. That is, the gear 108*b* or 108*b* and the support shaft 110*a* or 110*b* are now in rotation in opposite direction from each other.

Therefore, when the reverse solenoid SL1 is in off position, the pawl portion 113*b* of the clutch pawl 113 is in engagement with the collar 109*b*, and the rotation force of the drive gear 107 is transmitted to the gear 112 through the gears 108*c* and 108*a*, collar 109*a*, shaft 110*a* and gear 111*a* as shown at the solid arrow; further, the refeeding belt 101 is driven forward in clockwise direction (in the direction of refeed) through the shaft 102 and pulley 104. In contrast, when the solenoid SL1 is turned on, the pawl portion 113*a* of the clutch pawl 113 is in engagement with the collar 109*a*, and the rotation force of the drive gear 107 is transmitted to the gear 112 through the gear 108*b*, collar 109*b*, shaft 110*b* and gear 111*b* as shown at the dashed arrow; further, the refeeding belt 101 is driven reverse in counterclockwise direction through the shaft 102 and pulley 104. Reverse run of the refeeding belt 101 is intended to ensure prevention of duplicate sheet refeed during the refeeding operation. As will be explained hereinafter, each time refeed of a sheet is completed, refeeding belt 101 run is changed over to reverse run.

Between the drive shaft 106 and the drive gear 107 there is interposed a clutch not shown, so that the two are engaged with and disengaged from each other by switching on and off the refeeding solenoid SL5.

As shown in FIG. 6, the separation pad 120 is fixed through a support plate 121 to a support shaft 122 rotatably supported between the frames 41 and 41. A plunger 124 and coil spring 125 of a separation solenoid SL2 are connected to an arm 123 fixed to one end of the support shaft 122. The separation solenoid SL2 is normally in off condition, and the separation pad 120 presses against the refeeding belt 101 by the support shaft 122 being biased by the coil spring 125 in counterclockwise direction. When the separation solenoid SL2 is turned on, the support shaft 122 is rotated clockwise along with the arm 123 so that the separation pad 120 is moved away from the surface of the refeeding belt 101.

The refeeding belt 101 operates to give transport force by the force of its friction with each sheet. It is for the following reason that duplicate sheet refeed is prevented by the separation pad 120 pressing against the refeeding belt 101. The force of friction $\mu 1$ between the refeeding belt 101 and each sheet is set greater than the force of friction $\mu 2$ between individual sheets. The force of friction $\mu 3$ between the separation pad 120 and each sheet is also set greater than the force of friction $\mu 2$ between individual sheets, but it is set smaller than the force of friction $\mu 1$ between the refeeding belt 101 and each sheet. These relations are expressed as follows:

$\mu 1 > \mu 2$ $\mu 1 > \mu 3 > \mu 2$

Now, the sheet refeeding operation will be explained with reference to FIGS. 8*a*, 8*b* and 8*c*.

When a signal for sheet refeed is issued, the transport motor is turned on and the rollers 130, 131, etc. on the downstream side in the direction of sheet refeed are driven to rotate, and simultaneously the presser plate 80 is turned counterclockwise so that the upper edge of sheets P stored in the intermediate storing section 70 is pressed against the refeeding belt 101. Next, the refeeding belt 101 is driven forward in counterclockwise direction and accordingly a sheet p1 (initially received sheet) is carried upward. Thereupon, a second sheet P2 or more sheets are forwarded. The second sheet P2 is halted when it goes in contact with the separatIon pad 120, and only the first sheet P1 is passed through the separation pad 120 and transported upward, being then held between the rollers 130 and 131 and refed forward from the pair of rollers 31 on the copying machine 1.

When the fact that the front end of the first sheet P1 is held between the rollers 130 and 131 is confirmed through the signal from the sensor SE3, the forward run of the refeeding belt 101 is stopped and simultaneously the presser plate 80 is reset to its original position, that is, the so)id line position, whereby pressure on the upper edge of the remaining sheets is relieved. When it is detected by the sensor SE3 that the rear end of the first sheet P1 has passed through the refeeding section 100, the separation pad 120 is moved away from the surface of the refeeding belt 101 and the reverse solenoid SL1 is turned on to drive the refeeding belt 101 reverse, that is, in clockwise direction, whereby the succeeding second sheet P2 or more sheets which have been transported to a position between the refeeding belt 101 and the separation pad 120 are brought back to their original position.

If the separation pad 120 remains pressed against the refeeding belt 101, it is likely that the second sheet P2 will be refed in quick succession to the first sheet P1, or a third and further subsequent sheets which have been carried to the location of the separation pad 120 will be refed at same time. However, by moving the separation pad 120 away from the refeeding belt 101 and also by reverse run of the refeeding belt 101, such possible duplicate refeed can be positively prevented.

in addition to the above described operation of refeed, it is further noted that when the front end of a sheet being refed is detected by the sensor SE3, the side regulating plates 95 and 95 begin to move outwardly of the predetermined regulating positions at both sides of the sheets, and upon receipt of the signal from the sensor SE3 indicating the detection of the rear end of the sheet, the side regulating plates 95 and 95 are moved back inward until they beat the sides of the sheets stored. Thereupon, the sheets stored are vibrated and accordingly return of the sheets fed following the preceding second sheet P2 and other sheets to their original position is furthered, which is no doubt very helpful in preventing duplicate refeed.

Furthermore, in response to the rear end detection signal from the sensor SE3, the lower regulating plate 82 moves downward from its lower sheet end regulating position and then moves upward back to the regulating position. The sheets stored also move downward and upward in conjunction with such movement of the lower regulating plate 82, whereby return of the sheets fed in quick succession to a preceding one can be more positively assured and concurrently sheets stored can be better aligned, which fact surely contributes much toward prevention of duplicate refeed. (Control circuit)

Figure 9:
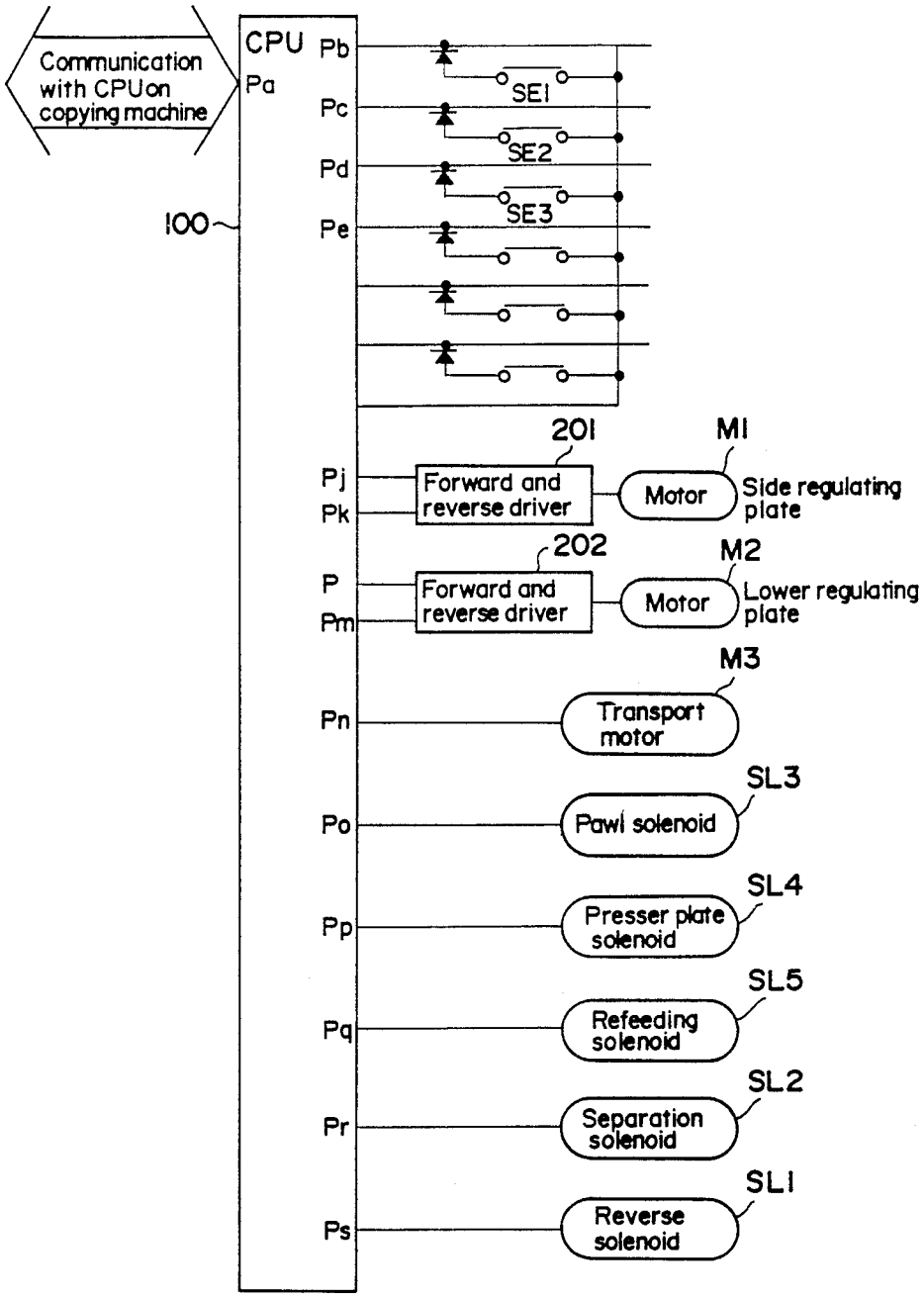

A control circuit for above mentioned refeeding apparatus is described referring to FIG. 9.

The processing is performed by a microcomputer 200 (hereinafter referred to as CPU). With the CPU 200; the sensors SE1, SE2 and SE3 are connected to input ports Pb, Pc and Pd; the motor M1 capable of forward and reverse rotation for actuating the side regulating plates 95 and 95 is connected to output ports Pj and Ph via a driver 201; the motor M2 capable of forward and reverse rotation for actuating the lower regulating plate 82 is connected to output ports P1 and Pm via a driver 202. The transport motor M3 is connected to an output port Pn; the solenoid SL3 for actuating the changeover pawl 53 is connected to an output port Po; the solenoid SL4 for actuating the presser plate 80 is connected to an output port Pp; the solenoid SL5 for actuating the clutch of the driving gear 107 is connected to an output port Pq; the solenoid SL2 for actuating the separation pad 120 is connected to an output port Pr; the solenoid SL1 for actuating the clutch pawl 113 is connected to an output port Ps. (Control procedure)

The control procedure of the refeeding apparatus carried out by the CPU 200 is hereinafter described in detail referring to FIGS. 10, 11*a*, 11*b*, 12*a* and 12*b*.

In the following paragraphs, the term "on-edge" is defined as change in status, where the switch, sensor, signal or the like changes from the off status to the on status. In contrast, the term "off-edge" represents change in status, where the switch, sensor, signal or the like changes form the on status to the off status.

Figure 10:
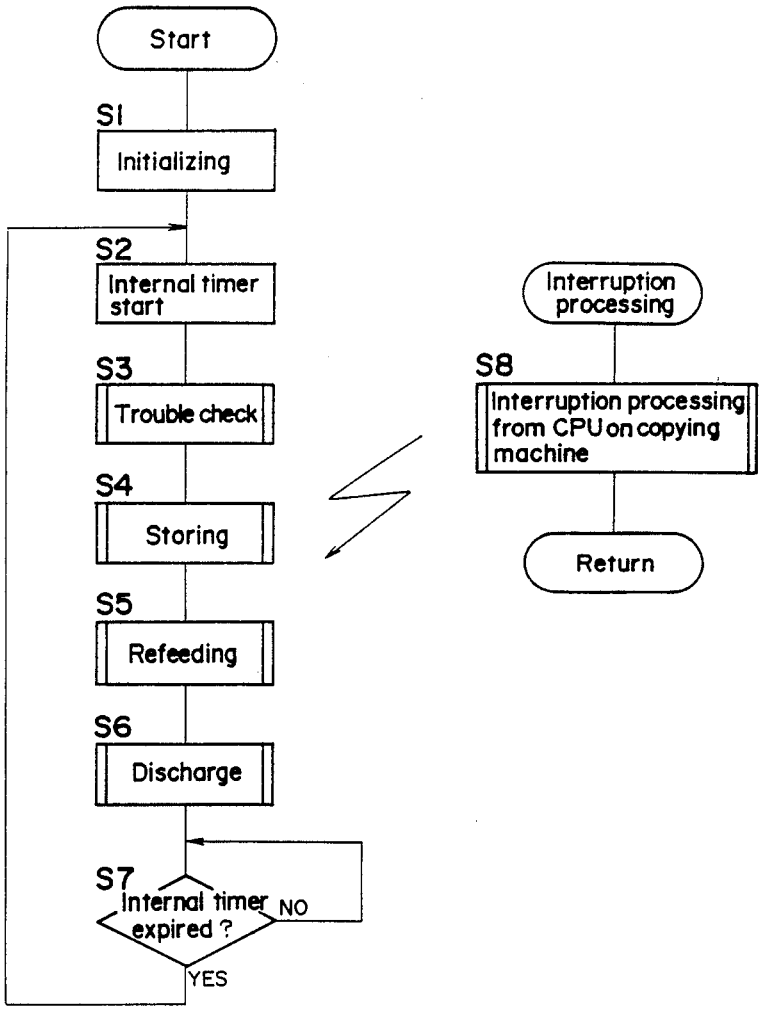

FIG. 10 is a flow chart showing the main routine carried out by the CPU 200.

When the power is turned on, the CPU 200 is reset and the program is started, at step 1, the CPU 200 clears a random access memory and initializes various registers built in the CPU 200 and various elements. Next, at step S2, an internal timer is started. The internal timer determines a required duration of the main routine, which is to be set in advance at the time of initialization at said step S1.

Then, subroutines at steps S3 through S6 are called. When all the subroutines have been terminated, at step S7 the CPU 200 waits for the completion of counting cycle of the internal timer and returns to said step S2. With various timers used in various subroutines, the count of each timer is performed based on the duration of one cycle of the main routine.

The subroutine at step S3, check is made to see that there is no sheet jamming or defective performance of each motor and solenoid, etc. The subroutine at step S4, when the duplex/composite copying mode is selected, operation for storing one-side copied sheets in the intermediate storing section 70 is carried out. The subroutine at step S5, operation for refeeding sheets stored therein one by one from the intermediate storing section 70 is carried out. The subroutine at step S6, operation for delivering the sheets into the discharge tray 64 or sorter (not shown) under the one-side copying mode, or duplex/composite copied sheets under the duplex/composite copy mode is carried out.

Meanwhile, if an interruption signal is issued from the CPU on the copying machine 1, at step S8 an interruption processing is executed on the basis of the content of the signals.

Figure 11A:
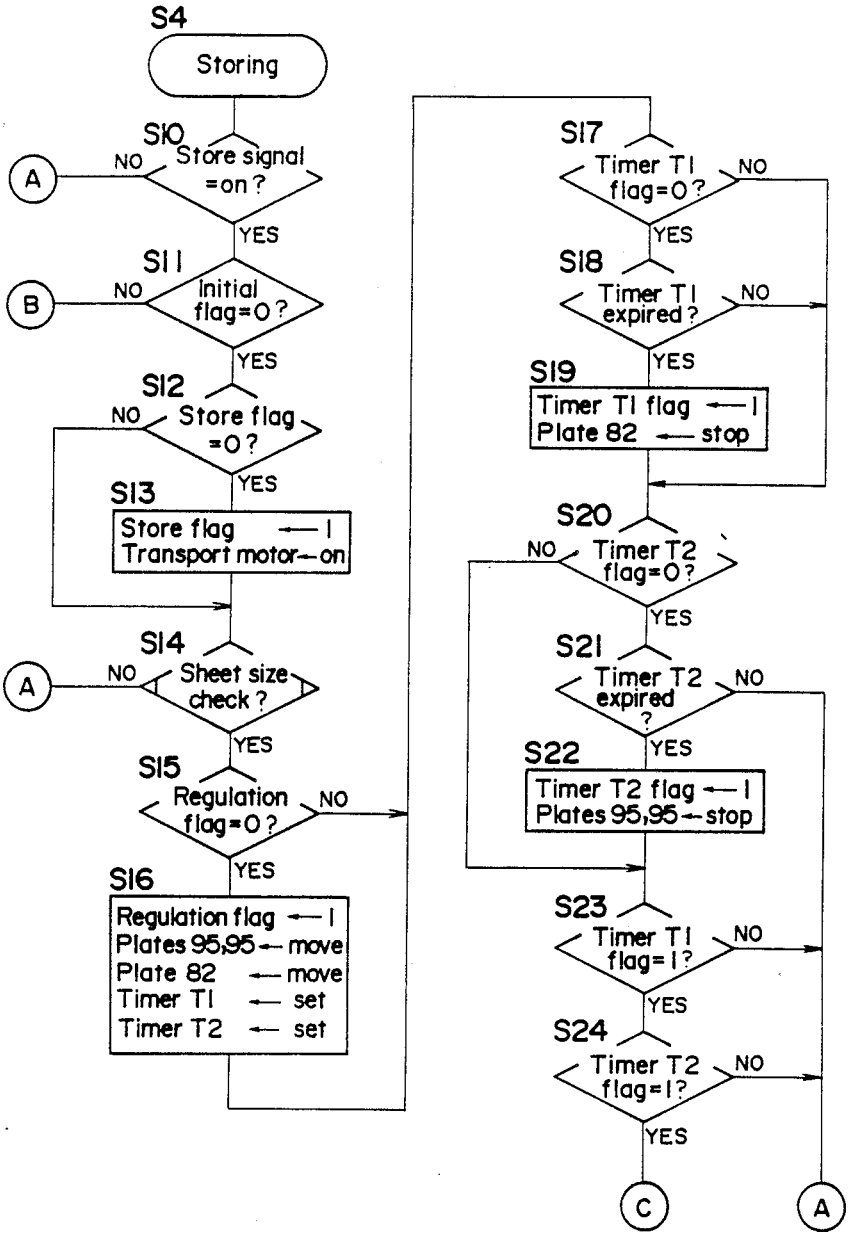
FIGS. 11*a* and 11*b* are flow charts showing a subroutine for storing sheets.
Figure 11B:
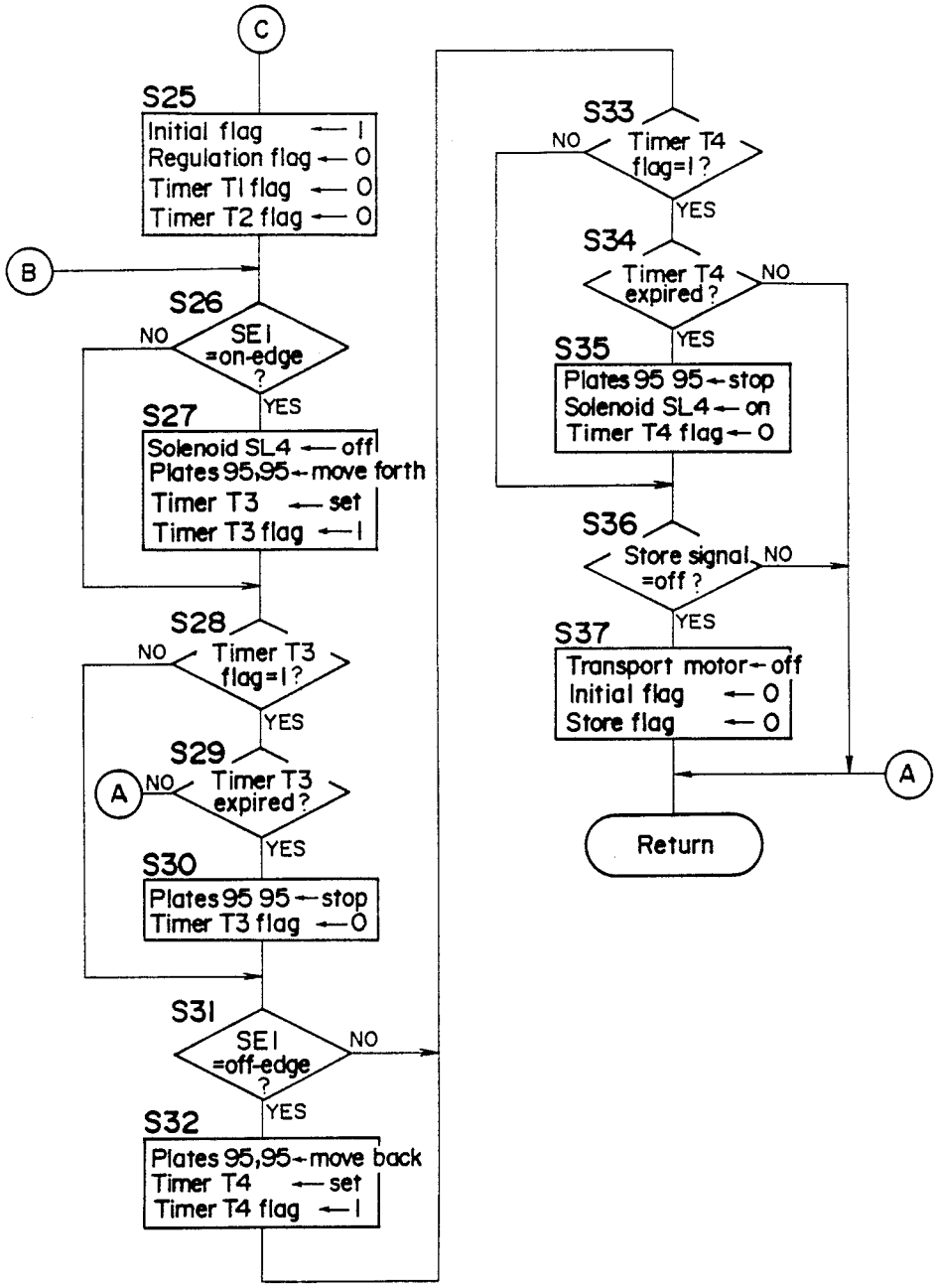

FIGS. 11*a* and 11*b* are flow charts showing the subroutine at step S4 of the main routine for storing sheets.

In this subroutine, first, whether or not a store signal has been set to on is judged at step S10. The store signal is issued as an on signal from the CPU on the copying machine 1 for one-side copying under the duplex/composite copying mode. Therefore, when the signal is not the on status, the processing is returned to the main routine at once; when the signal has been set to the on status, whether or not an initial flag is "1" is judged at step S11. The initial flag is a flag for instructing initialization in connection with sheet storing in the refeeding apparatus 40, that is, position setting for the lower regulating plate 82 and the side regulating plates 95 and 95, and when the initial flag is reset to "0", it indicates that initialization has not been completed. Accordingly, when the flag has been set to "1", the processing goes to step S26; when is reset to "0", the processing executes at step S12, etc.

More specifically, whether or not a store flag is "0" is judged at step S12, when the flag is "0", the flag is set to "1" and the transport motor M3 is turned on at step S13. The store flag is a flag for turning on the transport motor M3 one time for sheet storing. At step S14, the size of the sheet fed is checked on the basis of the size code transmitted from the CPU on the copying machine 1. The refeeding apparatus 40 can receive an A4 sizes longitudinal and latitudinal positioned, B5 sizes longitudinal and latitudinal positioned, A3 size longitudinal positioned, and B4 size longitudinal positioned, and if the sheet is of any other size, it is necessary to return to the main routine.

Next, at step S15, whether or not a regulation flag is "1" is judged. The regulation flag indicates that the lower regulating plate 82 and the side regulating plates 95 and 95 are in the course of movement to the regulating positions.

In that case, when the flag is "1", the processing goes to step S17; when the flag is "0", at step S16 the regulation flag is set to "1", the side regulating plates 95 and 95 and the lower regulating plate 82 are caused to start moving from their home positions, and timers T1 and T2 are set. The timers T1 and T2 are to determine the distance of movement of the lower regulating plate 82 and the side regulating plates 95 and 95, and may be changed according to the size of sheet checked at step S14.

Next, at step S17 whether or not a timer T1 flag is "0" is judged; when the flag is "0", at step S18 time up of the timer T1 is confirmed; and then at step S19, the timer T1 flag is set to "1" and the lower regulating plate 82 is caused to stop movement. Subsequently, at step S20 whether or not a timer T2 flag is "0" is judged; when the flag is "0", at step S21 time up of the timer T2 is confirmed; and then at step S22, the timer T2 flag is set to "1" and the side regulating plates 95 and 95 are caused to stop movement. Thus, the lower regulating plate 82 and the side regulating plates 95 and 95 have now been set at positions corresponding to the size of sheet.

Next, at steps S23 and S24, it is judged that bath the timer T1 flag and timer T2 flag have been set to "1", that is, termination of movement of the lower regulating plate 82 and the side regulating plates 95 and 95 is confirmed, whereupon the initial flag is set to "1", the regulation flag is reset to "0", and the timer T1 flag and the timer T2 flag are reset to "0" at step 825. Thus, preparation for sheet storing in the refeeding apparatus 40 has been completed.

Next, at step S26 whether or not the sensor SE1 is on-edge is judged; when the sensor SE1 has been just on-edge, that is, a one-side copied sheet is discharged from the copying machine 1, and when its front end is detected by the sensor SE1; at step S27, the presser plate solenoid SL4 is turned off for retreating the presser plate 80 to the solid line position shown in FIG. 2, the side regulating plates 95 and 95 are caused to start outward movement, a timer T3 is set, and a timer T3 flag is set to "1". The timer T3 is to determine positions to which the side regulating plates 95 and 95 are to be moved outward. Therefore, when it is judged that the timer 73 flag has been set to "1" at step S28, and time up of the timer T3 is confirmed at step S29, the side regulating plates 95 and 95 are caused to stop outward movement, and the timer T3 flag is reset to "0" at step S30.

At step S3l whether or not the sensor SE1 is off-edge is judged; when the sensor SE1 has been just off-edge, that is, when the rear end of the sheet has passed the sensor SE1, at step S32, the side regulating plates 95 and 95 are caused to start movement from the outwardly extended position back to the regulating position, a timer T4 is set, and a timer T4 flag is set to "1". The timer T4 is to determine the distance of return movement of the side regulating plates 95 and 95 to the initially set regulating positions. Therefore, when it is judged that the timer T4 flag has been set to "1" at step S33 and time up of the timer T4 is confirmed at step S34, the side regulating plates 95 and 95 are caused to stop their return movement at step S35. Simultaneously, the presser plate solenoid SL4 is turned on to pivotally move the presser plate 80 toward the base plate 75 so that the presser plate 80 presses against the upper edge portion of the sheets already stored and the timer T4 flag is reset to "0".

Next, at step S36 whether or not the store signal has been reset to off is judged. The store signal is turned off when a final sheet to be stored is discharged from the copying machine 1, and communication is given from the CPU on the copying machine 1 accordingly. Therefore, when the store signal is the off status, at step S37 the transport motor M3 is turned off, the initial flag and store flag are reset to "0", this subroutine is terminated.

Figure 12A:
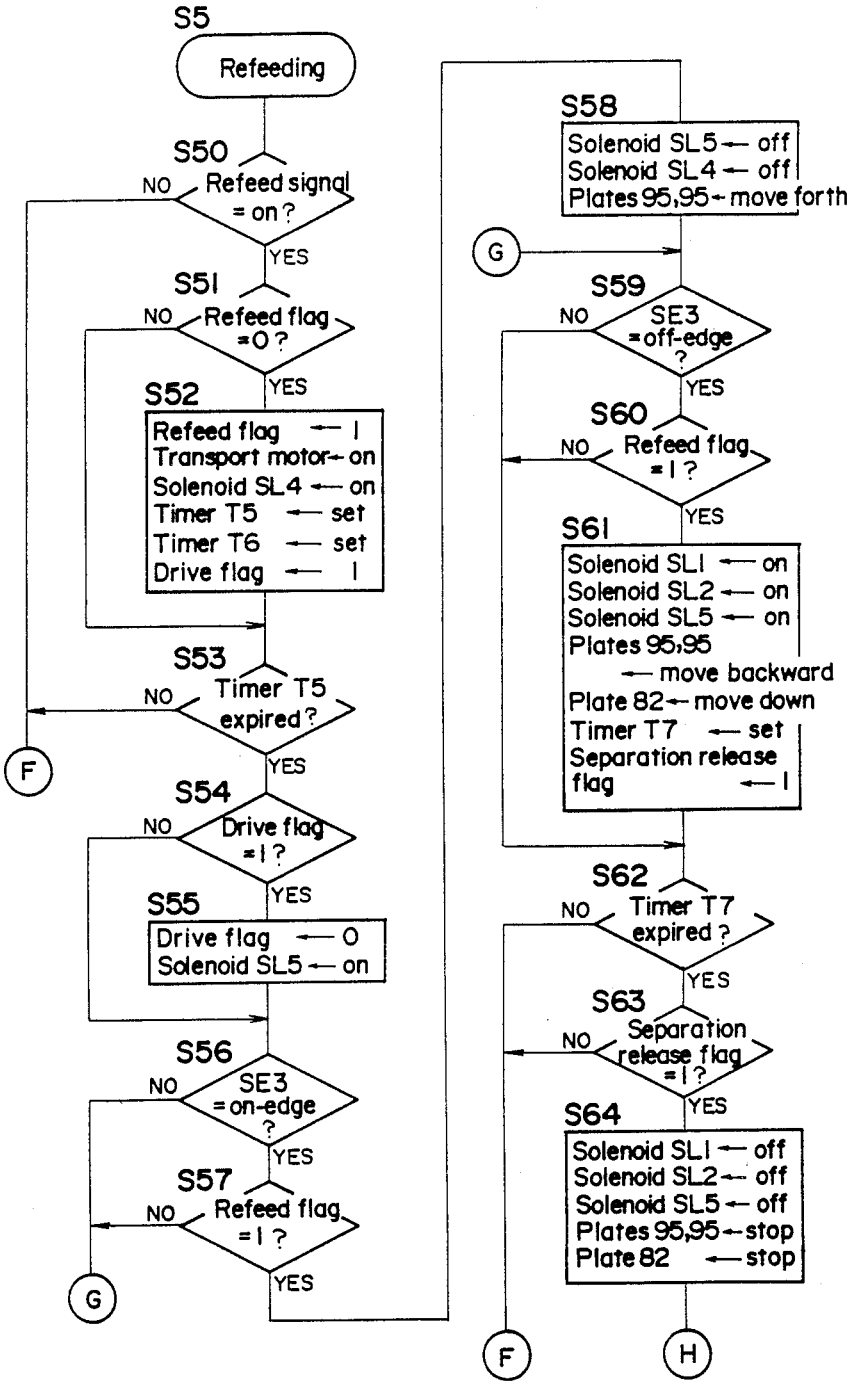
Figure 12B:
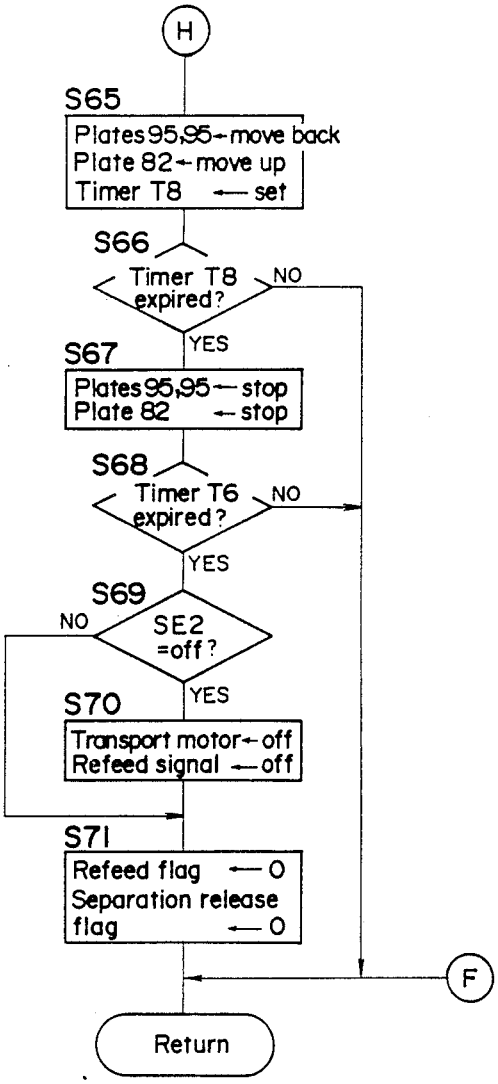

FIGS. 12*a* and 12*b* are flow charts showing the subroutine at step S5 of the main routine for refeeding sheets.

In this subroutine, first, at step S50 whether or not a refeed signal has been set to on is judged. The refeed signal is issued as an on signal from the CPU on the copying machine 1 after one-side copied sheets under the duplex/composite copying mode has all been stored in the intermediate storing section 70 and when a print key not shown on the copying machine 1 is pushed or original exchange at an automatic document feeder is made. Therefore, when the signal is the off status, the processing is returned to the main routine at once; when the signal has been set to the on status, at step S51 whether or not a refeed flag is "0" is judged. The refeed flag, when it is "1", indicates that one cycle of refeeding operation is being executed. Then, when the refeed flag has been reset to "0", at step 852 the transport motor M3 is turned on, and the presser plate solenoid SL4 is turned on to cause the pressing face 80*a* of the presser plate 80 to press the upper end of the sheets against the refeeding belt 101. Simultaneously, timers T5 and T6 are set and a drive flag is set to "1". The timer T5 is to ensure that the upper ends of the sheets are positively pressed by the presser plate 80 against the refeeding belt 101. The timer T6 is to determine time intervals at which the sheets are to be refed one by one, which value is subject to change according to the sheet size. The drive flag, when it is "1", indicates that the refeeding solenoid SL5 is turned on in order to drive the refeeding belt 101 to run forward once a cycle of refeed operation.

At step S53 time up of the timer T5 is confirmed, and at step S54 when it is judged that the drive flag has been set to "1", then at step S55, the drive flag is reset to "0" and simultaneously the refeeding solenoid SL5 is turned on, whereby the refeeding belt 101 is driven forward and the first sheet P1 is refed as shown in FIG. 8*b*.

Next, at step S56 whether or not the sensor SE3 is on-edge is judged; when the sensor SE3 has been just on-edge, that is, when the front end of the refed sheet is detected by the sensor SE3, at step S57, it is confirmed that the refeed flag is "1"; and at step 858 the refeeding solenoid SL5 is turned off to stop the forward run of the refeeding belt 101. Further, the presser plate solenoid SL4 is turned off to relieve the presser plate 80 of its pressing of the upper end of the sheets. Simultaneously, the side regulating plates 95 and 95 are caused to start outward movement. Thereupon, the first sheet P1 is carried at it front end between the rollers 130 and 131, being refed forward under transport force of the rollers 130 and 131.

At step 859, whether or not the sensor SE3 is off-edge is judged; when the sensor SE3 has been just off-edge, that is, when the rear end of the refed sheet has passed the sensor SE3, at step S60, it is confirmed that the refeed flag is "1"; and at step S61, the separation solenoid SL2 is turned on to relieve the press contact of the separation pad 120 with the refeeding belt 101. Simultaneously, the reverse solenoid SL1 and the refeeding solenoid SL5 are turned on to replace the clutch pawl 113 so that the refeeding belt 101 is driven reverse. Thereupon, a sheet or sheets which have been carried to the position of the separation pad 120 accompanying the refed forward sheet P1 are brought back to their original position. At this step S61, the side regulating plates 95 and 95 are caused to move back in the directions of their distance contraction, and at the same time the lower regulating plate 82 is caused to start downward movement. Further, a timer T7 is set and a separation release flag is set to "1". The timer T7 is to determine timing for stopping return movement of the side regulating plates 95 and 95, etc. The separation release flag, when it is "1", is a flag for moving the separation pad 120 away from the refeeding belt 101 once during one cycle of sheet refeeding.

Next, at step S62, when time up of the timer T7 is confirmed, and at step S63, when it is judged that the separation release flag has been set to "1", at step S64, the solenoids SL1, SL2 and SL5 are turned off. Thereupon, the separation pad 120 presses against the refeeding belt 101 is stopped. Simultaneously, the return movement of the side regulating plates 95 and 95 in the directions of their distance contraction is brought to a stop, and the downward movement of the lower regulating plate 82 is also stopped. Subsequently, at step S65, the side regulating plates 95 and 95 are caused to start return movement to their regulating positions corresponding to the sheet size, and the lower regulating plate 82 is caused to start upward movement to its regulating position corresponding to the sheet size. Further, a timer T8 is set, which is to determine timing for return of the individual regulating plates 82, 95 and 95 to their respective sheet regulating positions.

Therefore, when time up of the timer T8 is confirmed at step S66, the return movement of the regulating plates 95, 95 and 82 are stopped at step S67, whereby the regulating plates 95, 95 and 82 are set at proper regulating positions. The above described manner of operation, that is, that sheets are beaten at their sides by the side regulating plates 95 and 95 through their traverse movements, and that sheets are caused to move downward and upward in conjunction with the downward and upward movement of the lower regulating plate 82, assure that sheets are aligned move positively and accurately.

Next, at step S68 whether or not the timer T6 is expired is judged, when the timer T6 has been expired, at step S69 whether or not the sensor SE2 is on-edge is judged.

The sensor SE2 is kept in the on status while the sheets are stored in the intermediate storing section 70, and it is turned off when all the sheets have been refed. Therefore, when the sensor SE2 is in the on status, at step S71 the refeed flag and the separation release flag are reset to "1", preparation is made for next one cycle of sheet refeeding. In contrast, when the sensor SE2 is in the off status, at step S70 the transport motor M3 is turned off, the refeed signal is turned off, the processing is executed at said step S70 and terminated this subroutine.

[Other Embodiments]

The sheet storing apparatus in accordance with the present invention is not limited to the above described embodiment. Various changes and modifications may be made in the invention within the subject matter thereof.

The apparatus of the invention can be applied not only for purposes of sheet refeeding in particular, but also in various other ways, for example, as a sheet storing apparatus for binding or stapling a plurality of sheets, or as an apparatus for merely storing sheets in vertical alignment.

The second guide members 89 and 89 of the intermediate storing section 70 may be constructed of a resilient material and arranged to be resiliently urged toward sheets. The first guide members 88 and 88 for regulating the sides of sheets may be made of a resilient material and the second guide members 89 and 89 for centrally regulating sheets may be made of a rigid material.

Figure 13:
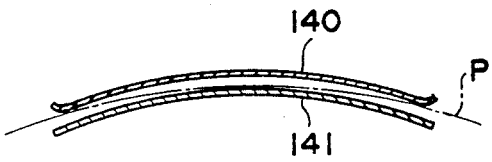
FIG. 13 is a cross sectional plan view of a storing section of another embodiment.
Figure 14:
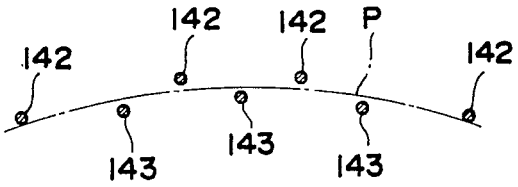
FIG. 14 is a cross sectional plan view of a storing section of another embodiment.

Further, as shown in FIG. 13, a first guide member 140 and a second guide member 141 may be in the form of a curved plate-like member. As shown in FIG. 14, it is also possible that a first guide member 142 and a second guide member 143 made of a wire material may be arranged in an alternate zigzag pattern so that sheets are conveniently bent to obtain good nerve to resist buckling.

The paddle wheel 90 may be supplied with rotational drive force generated by a special type of motor, but as described with respect to the embodiment of the invention, it is more convenient to drive by a transport motor M3 for the rollers 51, 73, etc. which mans simplified control.

Figure 15:
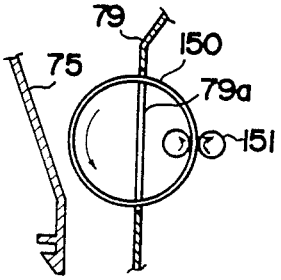
FIG. 15 is a cross sectional elevational view of a wheel member of another embodiment.

The paddle wheel 90 may be replaced by an endless belt 150 as shown in FIG. 15. This belt 150, carried between a pair of rollers 151, is given rotation force in a clockwise direction, whereby it is rotated while keeping itself in an arcuate configuration under inertia and in such condition that it projects toward the base plate 75 through the opening **79*a* of the guide plate 79**, supplementary transport force being thus given to each sheet being stored.

For timing for traverse movement or upward and downward movement of the regulating plates 95, 95 and 82, it is considered possible to adopt various control procedures in addition to those described with reference to the foregoing flow charts. Various changes and modifications may be considered with respect to belts, pads, etc. in addition to the foregoing description.

What is claimed is:

1. A sheet storing apparatus for storing sheets having an image formed thereon by an image forming apparatus in substantially vertically placed condition, comprising:

a receiving roller member for receiving each of the sheets discharged from said image forming apparatus and transporting the sheets substantially downward;

a bottom plate member for regulating the front end of each of the sheets transported downward by said receiving roller member so that the sheets are substantially vertically held thereon; and guide means for guiding each of the sheets transported downward to said bottom plate member, said guide means including a first guide member which acts on both sides of the sheets and a second guide member which acts on the center portion of the sheets, thereby curving the sheets.

2. A sheet storing apparatus as set forth in claim 1, wherein said second guide member is made of a resilient material.

3. A sheet storing apparatus as set forth in claim 1, wherein said bottom plate member is movable up and down.

4. A sheet storing apparatus for storing sheets having an image formed thereon by an image forming apparatus in substantially vertically placed condition, comprising:

a receiving roller member for receiving each of the sheets discharged from said image forming apparatus and transporting the sheets substantially downward;

a bottom plate member for regulating the front end of each of the sheets transported downward by said receiving roller member so that the sheets are substantially vertically held thereon;

a guide member for guiding each of the sheets transported downward to said bottom plate member; and a wheel member rotated in a direction for urging each of the sheets transported by said receiving roller member downward toward the bottom plate member, said wheel member disposed at a distance form said guide member so that the urging force varies with the number of sheets received in the sheet storing apparatus.

5. A sheet storing apparatus as set forth in claim 4, wherein the distance between said receiving roller member and said wheel member is set shorter than the length of the sheet having the minimum size capable of being stored.

6. A sheet storing apparatus for storing sheets having an image formed thereon by an image forming apparatus in substantially vertically placed condition and subsequently refeeding the stored sheets to said image forming apparatus, comprising:

a sheet storing unit for storing sheets in substantially vertically placed condition;

side regulating means, which are disposed at both sides of said sheet storing unit and movable in a direction perpendicular to the sheet storing direction, for regulating the side ends of the sheets;

refeeding means, which is rotatable in the refeeding direction, for refeeding the stored sheets;

separation means movable toward and away from said refeeding means and adapted to prevent more than one sheet at a time from being refed by said refeeding means;

detecting means for detecting each of the sheets refed by said refeeding means; and control means for causing said side regulating means to move back and forth and said separation means to move away from said refeeding means in response to the detection signal from said detecting means.

7. A sheet storing apparatus as set forth in claim 6, wherein said refeeding means is rotatable both forward and backward and adapted to be rotated backward in response to the detection signal from said detecting means.

8. A sheet storing apparatus for storing sheets having an image formed thereon by an image forming apparatus in a sheet storing unit and subsequently refeeding the stored sheets to said image forming apparatus, comprising:

side regulating means, which are disposed at both sides of said sheet storing unit and movable in a direction perpendicular to the sheet storing direction, for regulating the side edges of the sheets;

refeeding means, which is rotatable in the refeeding direction, for refeeding the stored sheets;

detecting means for detecting each of the sheets refed by said refeeding means; and control means for causing said side regulating means to move back and forth in response to the detection signal form said detecting means.

9. A sheet storing apparatus as set forth in claim 8, further comprising separation means movable toward and away from said refeeding means and adapted to prevent the sheets from being refed by said refeeding means in plurality at a time, said separation means being caused to move away from said refeeding means in response to the detecting signal from said detecting means.

10. A sheet storing apparatus for storing sheets having an image formed thereon by an image forming apparatus in a sheet storing unit in substantially vertically placed condition and subsequently refeeding the stored sheets to said image forming apparatus, comprising:

lower regulating means, which is movable in the vertical direction, for regulating the lower end of the sheets stored in aid sheet storing unit;

refeeding means, which is rotatable in the refeeding direction for refeeding the stored sheets;

separation means movable toward and away from said refeeding means and adapted to prevent more than one sheet at a time from being refed by said refeeding means;

detecting means for detecting each of the sheets refed by said refeeding means; and control means for causing said lower regulating means to move down and up and said separation means to move away from said refeeding means in response to the detection signal from said detecting means.

11. A sheet storing apparatus as set forth in claim 10, wherein said control means causes said lower regulating means to move downward upon the detection of each sheet by said detecting means, then to move upward to its original position.

12. A sheet storing apparatus as set forth in claim 11, wherein said refeeding means is rotatable both forward and backward and adapted to be rotated backward in response to the detection signal from said detecting means.

13. A sheet storing apparatus for storing sheets having an image formed thereon by an image forming apparatus in a sheet storing unit and subsequently refeeding the stored sheets to said image forming apparatus, comprising:

regulating means, which is movable toward and away from the side edges of the sheets, for regulating the end of the sheets stored in said sheet storing unit;

refeeding means, which is rotatable in the refeeding direction, for refeeding the stored sheets;

detecting means for detecting each of the sheets refed by said refeeding means; and control means for causing said regulating means to move back and forth in response to the detection signal from said detecting means.

14. A sheet storing apparatus as set forth in claim 13, wherein said refeeding means is rotatable both forward and backward and adapted to be rotated backward in response to the detection signal from said detecting means.

15. A sheet storing apparatus for storing sheets having an image formed thereon by an image forming apparatus in a sheet storing unit in substantially vertically placed condition and subsequently refeeding the stored sheets to said image forming apparatus, comprising:

first regulating means, which is movable in the vertical direction, for regulating the lower end of the sheets stored in said sheet storing unit;

second regulating means, which is movable in the horizontal direction, for regulating the side edges of the sheets stored in said sheet storing unit;

refeeding means, which is rotatable in the refeeding direction, for refeeding the stored sheets;

separation means movable toward and away from said refeeding means and adapted to prevent more than one sheet at a time from being refed by said refeeding means;

detecting means for detecting each of the sheets refed by said refeeding means; and control means for causing said separation means to move away from said refeeding means and said first and second regulating means to move back and forth in response to the detection signal from said detecting means.

16. A sheet storing apparatus as set forth in claim 15, wherein said refeeding means is rotatable both forward and backward and adapted to be rotated backward in response to the detection signal from said detecting means.

17. A sheet storing apparatus for storing sheets having an image formed thereon by an image forming apparatus in substantially vertically place condition, comprising:

a receiving roller member for receiving each of the sheets discharged form said image forming apparatus and transporting the sheets substantially downward;

a bottom plate member for regulating the front end of each of the sheets transported downward by said receiving roller member so that the sheets are substantially vertically held thereon; and guide means for guiding each of the sheets transported downward to said bottom plate member, said guide means including a pair of curved plates, thereby holding the sheets curved in width.

18. A sheet storing apparatus for storing sheets having an image formed thereon by an image forming apparatus in a sheet storing unit in substantially vertically placed condition and subsequently refeeding the stored sheets to said image forming apparatus, comprising:

support means for supporting the sheets stored in said sheet storing unit in substantially vertically place condition;

refeeding means, which is rotatable in the refeeding direction, for refeeding the stored sheets;

separation means movable toward and away from said refeeding means and adapted to prevent more than one sheet at a time from being refed by said refeeding means;

detecting means for detecting the trailing end of each of the sheets refed by said refeeding means; and control means for causing said separation means to move away from said refeeding means in response to the detection signal from said detecting means.

19. A method for storing sheets having an image formed thereon by an image forming apparatus in substantially vertically placed condition, comprising the steps of:

receiving each of the sheets discharged from said image forming apparatus and transporting the sheet substantially downward;

regulating the front end of each of the sheets transported downward by regulating means so that the sheet are substantially vertically held thereon; and acting on both sides of the sheets transported downward by a first guide member and acting on the center portion of the sheets transported downward by a second guide member;

whereby the sheets regulated by said regulating means are curved in width.

* * * * *